United States Patent [19]

Malbon

[11] 4,050,125

[45] Sept. 27, 1977

[54] INFLATED CASKET

[76] Inventor: Clifford B. Malbon, 2140 Palmetto Ave., Apt. No. 1, South Daytona, Fla. 32019

[21] Appl. No.: 696,833

[22] Filed: June 17, 1976

[51] Int. Cl.[2] ..... A61G 17/00

[52] U.S. Cl. ..... 27/2

[58] Field of Search ..... 27/2, 7, 17

[56] References Cited

U.S. PATENT DOCUMENTS

| | | | |
|---|---|---|---|
| 500,809 | 7/1893 | Lakin | 27/17 |
| 535,955 | 3/1895 | Nativel | 27/7 |
| 1,490,737 | 4/1924 | Fuehrman | 27/7 |

*Primary Examiner*—John D. Yasko

*Attorney, Agent, or Firm*—John N. Randolph

[57] ABSTRACT

An inflated casket which may remain deflated for storage prior to use and for transportation prior to storage. The casket body is provided with one or a plurality of chambers into which a fluid substance is injected for distending the chambers to cause the casket body to assume an erect position for use. The fluid substance while usually in the form of a gas, such as air, may constitute a substance which will subsequently solidify to produce a substantially rigid casket body.

9 Claims, 5 Drawing Figures

FIG. 1
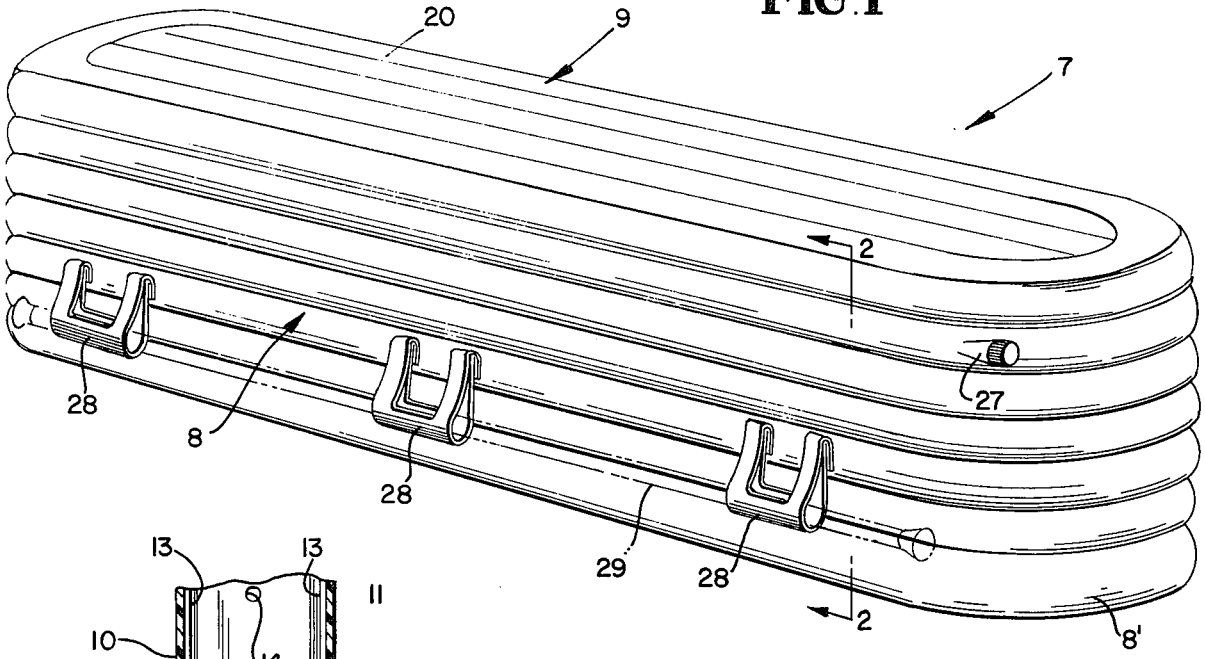
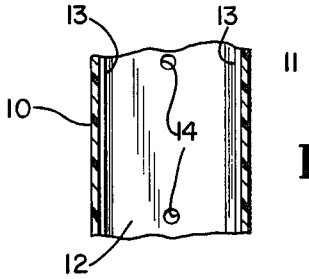
FIG. 3
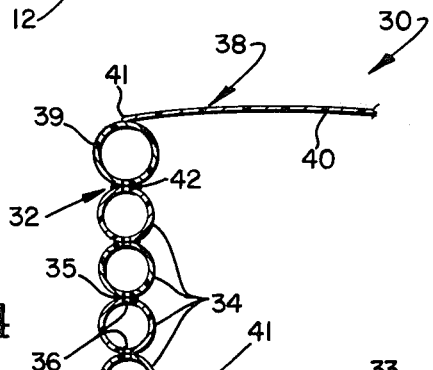
FIG. 4
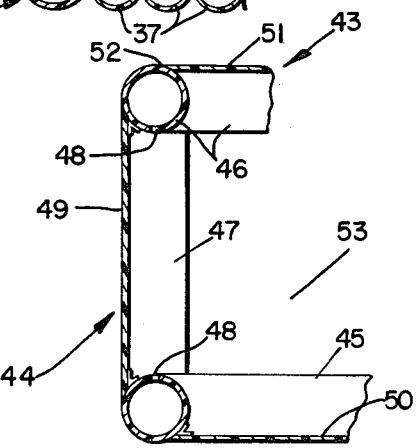
FIG. 5
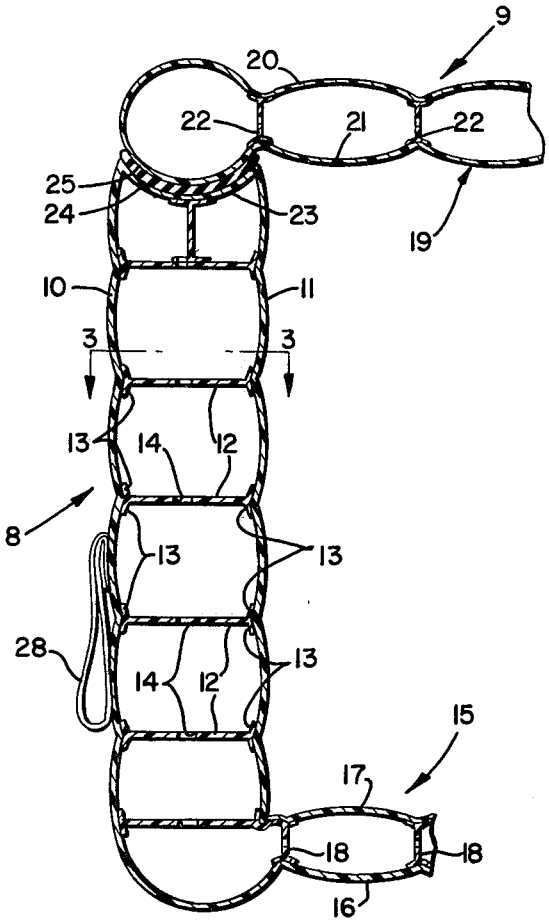
FIG. 2

INFLATED CASKET

SUMMARY

It is a primary object of the present invention to provide an inexpensive casket which is capable of being inflated for use and which can remain deflated to be stored in a very restricted space and for transportation prior to storage.

Another object of the invention is to provide such a casket which will be light in weight, inexpensive and durable.

Still a further object of the invention is to provide a casket which may be readily inflated for use and which will be substantially rigid when inflated.

Still a further object of the invention is to provide a casket which, when in use, may have the appearance of a conventional metal or wood casket.

Various other objects and advantages of the invention will hereinafter become more fully apparent from the following description of the drawing illustrating presently preferred embodiments thereof, and wherein:

BRIEF DESCRIPTION OF THE DRAWING

FIG. 1 is a perspective view of a preferred embodiment of the inflated casket;

FIG. 2 is an enlarged fragmentary transverse vertical sectional view of a part thereof, taken substantially along a plane as indicated by the line 2—2 of FIG. 1;

FIG. 3 is a fragmentary horizontal sectional view taken substantially along a plane as indicated by the line 3—3 of FIG. 2;

FIG. 4 is a fragmentary vertical sectional view, similar to FIG. 2, of a second embodiment of the casket, and FIG. 5 is a similar view of a third embodiment thereof.

DESCRIPTION OF THE PREFERRED EMBODIMENTS

Referring more specifically to the drawings, and first with reference to FIGS. 1 to 3, the inflated casket as disclosed therein and designated generally 7 comprises a casket body 8 and a cover 9 each formed of a flexible material, impervious to a gas or fluid, such as rubber or plastic.

The casket 7 is shown as having rounded ends 8'. Continuous side and end walls of the body 8 are composed of an outer ply 10 and an inner ply 11 which plies are connected by membranes or webs 12 having wide side edge portions 13 which are sealed to the inner sides of the plies 11 and 12 and which function to prevent spreading of plies when the body 8 is inflated to assume its erect position of FIGS. 1 and 2. The membranes 12 have perforations 14, FIGS. 2 and 3, through which an inflating fluid or gas can pass to equalize the pressure in the various chambers formed by said membranes.

The body 8 includes a bottom 15 having an outer ply 16 forming a continuation of the outer ply 10 and an inner ply 17 forming a continuation of the inner ply 11. The plies 16 and 17 are connected by additional membranes 18 in the same manner that the plies 10 and 11 are connected by the membranes. 12. Membranes 18 are of the same construction as the membranes 12.

The cover 9 comprises an envelope 19 having an outer ply 20 and an inner ply 21, which plies are connected by membranes 22, in the same manner that the plies 10 and 11 are connected by the membranes 12.

Membranes 22 are of the same construction as the membranes 13 and 18.

The vertical wall of the body 8 is closed at its upper edge by the wall member 23 which extends between and is preferably formed integral with the upper edges of the plies 10 and 11. A bonding medium 24 is interposed between the outer side of the wall member 23 and the underside 25 of the marginal portion of the cover 9 to hermetically seal the chamber 26 defined by the casket 7.

A valve 27 is shown in FIG. 1 communicating with the interior of the body 8. Said valve may be of the same type as used with pnuematic tires, or tubes for such tires, for inflating the body with air. A similar valve 27, not shown, is provided for the cover 9. The valves may be inconspicuously located internally of the body 8 and cover 9.

Handle loops 28 are provided on each side of the body 8, connected to the outer ply 10 and externally thereof. The handles 28 may be utilized for lifting or carrying the casket 7 or for receiving removable pole-like handles 29 by which the casket and its occupant may be conveniently carried by pallbearers.

FIG. 4 illustrates a second embodiment of the casket, designated generally 30. having a body 31 including an endless surrounding wall 32 and a bottom 33. The wall 32 includes straight side portions and rounded end portions, like the surrounding wall of the casket 7, composed of endless tubes 34 which are stacked one on top of the other and which are suitably connected by an adhesive bond 35, where said tubes abut. Ports 36 are provided through said abutting portions for the passage therethrough of the inflating medium, for equalizing the pressure. The bottom 33 is likewise composed of tubes 37 certain of which or all of which may be endless and which likewise may be bonded together, as seen at 35, and provided with communicating ports 36. The casket 30 has a cover 38 composed of an endless tube 39 and a plate or sheet 40 the marginal portion of which is bonded to or formed integral with the top surface of the tube 39. A chamber 41 defined by the casket 30 is closed by the cover 38 which is secured to the topmost tube 34, on which the tube 39 rests, by a sealing medium 42, by means of which the chamber 41 is hermetically sealed.

FIG. 5 illustrates the third embodiment of the casket, designated generally 43, having a body 44 composed of a tubular bottom rectangular frame 45, a tubular top rectangular frame 46 and tubular corner posts 47. Ports 48 are shown connecting portions of the top and bottom frames to the corner posts so that all parts of the frames communicate with one another. A single valve, not shown, such as the valve 27, may be utilized to receive air under pressure from a suitable source for pressurizing the frames 45, 46, 47. Side and end walls 49 are suitably secured to or formed integral with the bottom and top frames 45 and 46 and a bottom wall 50 is suitably secured to or formed integral with the tubular bottom 45 to complete the body 44. A cover 51 of single thickness may be secured by a suitable bonding medium 52 continuously around its marginal edges to the top frame 46 for hermetically sealing the cavity 53 of the casket 43 prior to burial.

A foam substance may be injected into the chambers of the caskets of all embodiments and which will subsequently solidify to produce a very solid casket structure.

The caskets 7, 30 and 43 may have various finishes and may include inflated built-in mattresses and pillows and various decorative accessories.

Various other modifications and changes are contemplated and may be resorted to without departing from the function or scope of the invention.

I claim as my invention:

1. A casket comprising a body and a cover each formed in part of a hollow inflatable material, said body comprising a bottom and an upstanding surrounding wall including at least one inflated chamber by which said wall is supported, said bottom and wall defining the interior of the casket, said cover having a marginal portion engaging an upper surface of said surrounding wall, and means sealing the connection between said marginal portion of the cover and said surrounding wall to provide a hermetic seal for the chamber defined by the casket.

2. A casket as in claim 1, said bottom being secured to the bottom portion of said surrounding wall.

3. A casket as in claim 2, said bottom defining an inflated chamber in communication with the chamber of said surrounding wall.

4. A casket as in claim 1, and valve means through which the chambers of the casket are inflated.

5. A casket as in claim 1, said surrounding wall including an inner ply and an outer ply, membranes extending between and secured to said plies and being perforated for the passage therethrough of an inflating medium.

6. A casket as in claim 5, said body having a bottom including inner and outer plies forming continuations of the inner and outer plies, respectively, of said surrounding wall, and perforated membranes connecting the plies defining said bottom.

7. A casket as in claim 6, said cover comprising a single envelope of which said marginal portion constitutes a part, and perforated membranes disposed between and connected to the plies of said envelope.

8. A casket as in claim 1, said surrounding wall comprising a plurality of stacked tubes secured together and having ports formed in the connecting portions thereof to form communicating passages between the tubes, and said body having a bottom composed of tubes connected together and having communicating passages through the connected portions thereof to define a bottom chamber in communication with the chamber of said surrounding wall.

9. A casket as in claim 1, said chamber of said surrounding wall comprising an endless tubing constituting a bottom frame of the body, an endless tubing constituting a top frame of the body, tubular corner posts extending between and in communication with the bottom and top frames, and sheet-like wall members extending between and connecting the top and bottom frames and disposed around said corner posts.

* * * * *